US008528217B2

(12) United States Patent
Kondo et al.

(10) Patent No.: US 8,528,217 B2
(45) Date of Patent: Sep. 10, 2013

(54) ELECTRIC TOOL AND REMOTE CONTROL HOLDER FOR THE ELECTRIC TOOL

(75) Inventors: Masaki Kondo, Anjo (JP); Ryosuke Ito, Anjo (JP)

(73) Assignee: Makita Corporation, Anjo (JP)

( * ) Notice: Subject to any disclaimer, the term of this patent is extended or adjusted under 35 U.S.C. 154(b) by 13 days.

(21) Appl. No.: 12/864,717

(22) PCT Filed: Jan. 28, 2009

(86) PCT No.: PCT/JP2009/051368

§ 371 (c)(1),
(2), (4) Date: Jul. 27, 2010

(87) PCT Pub. No.: WO2009/098984

PCT Pub. Date: Aug. 13, 2009

(65) Prior Publication Data

US 2010/0314146 A1 Dec. 16, 2010

(30) Foreign Application Priority Data

Feb. 6, 2008 (JP) ..... 2008-026866

(51) Int. Cl.
*B26B 27/00* (2006.01)

(52) U.S. Cl.
USPC ..... 30/296.1; 439/529; 439/680

(58) Field of Classification Search
USPC ..... 173/162.1, 162.2; 30/296.1, 381–387; 439/500, 529, 680
See application file for complete search history.

(56) References Cited

U.S. PATENT DOCUMENTS

| | | | | |
|---|---|---|---|---|
| 4,207,675 | A * | 6/1980 | Causey et al. | 30/296.1 |
| 5,718,050 | A * | 2/1998 | Keller et al. | 30/123.4 |
| 5,896,669 | A * | 4/1999 | Uhl | 30/383 |
| 5,926,961 | A * | 7/1999 | Uhl | 30/296.1 |
| 6,502,949 | B1 * | 1/2003 | Horiyama et al. | 362/119 |
| 6,973,726 | B2 * | 12/2005 | Kramer | 30/216 |
| 7,152,328 | B2 * | 12/2006 | Champlin | 30/381 |
| 7,344,054 | B2 * | 3/2008 | Sakai et al. | 224/269 |
| D575,605 | S * | 8/2008 | Yamamoto et al. | D8/65 |
| 2002/0042997 | A1 * | 4/2002 | Uhl | 30/382 |

(Continued)

FOREIGN PATENT DOCUMENTS

| | | | |
|---|---|---|---|
| JP | 10286786 | A * | 10/1998 |
| JP | A-10-286786 | | 10/1998 |
| JP | A-2001-300867 | | 10/2001 |

OTHER PUBLICATIONS

International Search Report issued in International Patent Application No. PCT/JP2009/051368, dated Feb. 24, 2009.

*Primary Examiner* — Alexandra Elve
*Assistant Examiner* — Eyamindae Jallow
(74) *Attorney, Agent, or Firm* — Oliff & Berridge, PLC

(57) ABSTRACT

The purpose of the present invention is to maintain a better usability and a better electrical connection, while restricting burden on an attachment portion of an electric tool. In an attachment portion of a chain saw to which a battery pack is mounted, a pair of ribs are provided parallel to and on outer surfaces of the guide rails. On the contrary, a connecting member of a remote control holder has a connecting wall positioned outside the guide rails and having a pair of recessed grooves for allowing the pair of ribs to be fitted into the recessed grooves. The chain saw can be connected to the connecting member without utilizing the guide rails and by the engagement between the ribs and the connecting wall.

10 Claims, 10 Drawing Sheets

(56) References Cited

U.S. PATENT DOCUMENTS

2005/0006114 A1* 1/2005 Racov et al. ..... 173/162.1
2007/0193038 A1* 8/2007 Dahlberg ..... 30/296.1
2008/0016705 A1* 1/2008 Machens et al. ..... 30/383
2008/0184568 A1* 8/2008 Gieske et al. ..... 30/383
2008/0196256 A1* 8/2008 Gieske et al. ..... 30/277.4
2009/0119933 A1* 5/2009 Mace et al. ..... 30/381
2010/0043234 A1* 2/2010 Pellenc ..... 30/123.4
2010/0237124 A1* 9/2010 Shima et al. ..... 227/8
2011/0179652 A1* 7/2011 Fohrenbach et al. ..... 30/383

* cited by examiner (A)

(B)

(A)

(B)

ELECTRIC TOOL AND REMOTE CONTROL HOLDER FOR THE ELECTRIC TOOL

TECHNICAL FIELD

The present invention relates to a rechargeable electric tool, such as a chain saw, in which an electric power source is supplied from a battery pack, and also to a remote control holder for holding the electric tool such that an operator can manipulate the electric tool remotely from his hand.

BACKGROUND ART

The applicant of this invention has proposed an invention disclosed in Patent Document 1 with respect to the aforementioned remote control holder (hereinafter simply referred to as a "holder"). This holder includes a connecting member connectable to an electric tool from which a battery pack has been removed, a switch restriction means provided on the connecting member and capable of retaining a switch of the electric tool in an ON state, a handle connected to the connecting member through a pipe and to which the battery pack is detachably mounted, a connecting means electrically connecting the electric tool and the battery pack mounted to the handle, and a switching means provided on the handle and configured to control an electric connection between the battery pack and the electric tool.

According to this holder, the connection between the electric tool and the connecting member is made only by utilizing an attachment structure between the electric tool and the battery pack. To be more specific, the connecting member has an insertion portion equipped with electrode terminal plates at the same positions as those of the battery pack, and at both sides of the insertion portion are provided hook buttons identical to those provided on the battery pack, so that when the insertion portion is inserted into an attachment portion of the electric tool, which is also used for insertion of the battery pack, the hook buttons can be engaged with and connected to corresponding recessed portions, etc. formed in the attachment portion of the electric tool.

As a connecting mechanism for connecting the electric tool and the battery pack, a slide connecting mechanism is also known, other than the hook buttons; the slide connecting mechanism includes a pair of guide rails provided on the attachment portion of the electric tool, a pair of slide rails provided on an upper surface of the battery pack and configured to be fitted inside and between the pair of guide rails by inserting the battery pack into a space between the pair of guide rails while sliding the slide rails relative to the guide rails, and a hook button provided on the battery pack and configured to be engageable with the attachment portion when the slide rails are snugly fitted into the corresponding guide rails. Further, electrode terminal plates are provided between the guide rails of the attachment portion in a manner parallel to the guide rails, and electrode terminals are disposed on the upper surface of the battery pack in the sliding direction so that when the battery pack is slid along the guide rails, the electrode terminal plates are held by the electrode terminals.

Therefore, when the slide connecting mechanism is used in the holder, slide rails and electrode terminals are respectively provided on upper surface of the connecting member.

Patent Document 1: Japanese Laid-open Patent Publication No. 10-286786

DISCLOSURE OF INVENTION

Problems to be Solved by the Invention

However, if the above-mentioned connecting mechanism for connecting the electric tool and the battery pack is used for the holder, the weigh of the electric tool is applied to an interlocked portion, such as the recessed portions and the guide rails, during the use of the holder. As these recessed portions and the guide rails are originally designed to withstand only the weight of the battery pack, the interlocked portion subjected to repeated actions of attachment and detachment of the holder are worn out. As a result, backlash occurs at the connection area between the interlocked portion and the connecting member and is transmitted to the electrode terminals. Consequently, noise or vibration is generated in the case where the holder is connected and also in the case where the battery pack is connected. This may lead to uncomfortable feeling for a user, or poor contact which further results in reduced service life of the terminals. As an embodiment in which the connecting mechanism is not utilized as it is, Patent Document 1 discloses another structure in which the connecting member has an arm extending along the housing of the electric tool. However, such a structure disadvantageously involves complicated shape of the connecting member, which increases cost.

In view of the above, the present invention seeks to provide an electric tool and a holder, which are simple in structure without considerably increasing the cost, and which can maintain a better usability and a better electrical connection while burden on the attachment portion of the electric tool is restricted.

Means for Solving the Problems

In order to achieve the above object, the invention as disclosed in claim 1 is an electric tool comprising an attachment portion to which a battery pack is detachably mounted as an electric power source and an interlocked portion provided on the attachment portion that is configured to be used for connection with a remote control holder. The battery pack is attached to the attachment portion through sliding engagement such that a pair of slide rails provided on the battery pack is fitted inside and between a pair of guide rails provided on the attachment portion. The interlocked portion is arranged as a pair of ribs each provided on an outer surface of the attachment portion and protruding therefrom parallel to the pair of guide rails.

In order to achieve the above object, the invention as disclosed in claim 3 is a remote control holder for an electric tool of claim 1 comprising a connecting member connectable to the attachment portion of the electric tool. Additionally, a switch restriction device capable of retaining a switch of the electric tool is connected to the connecting member in an ON state, and a handle is connected to the connecting member through a pipe and is configured such that the battery pack is detachably mounted thereto. A connecting member is configured to electrically connect the electric tool attached to the connecting member with the battery pack mounted to the handle, and a switching member is provided on the handle and is capable of controlling an electric connection between the electric tool and the battery pack by means of the connecting member. Finally, the connecting member has an interlocking portion configured to engage with the pair of ribs for supporting the attachment portion, so that the connecting member is connectable to the attachment portion by the engagement between the ribs and the interlocking portion.

In this holder, it is preferable that the interlocking portion is arranged as a pair of wall members positioned outside the pair of guide rails and having opposed surfaces in which a pair of recessed grooves are formed for allowing the pair of ribs to be fitted into the recessed grooves.

Further, in order to achieve the above object, the invention as disclosed in claim 8 is an electric tool equipped with a remote control holder, wherein a connecting member of a remote control holder for an electric tool according to any one of claims 3 to 7 is connected to an electric tool according to claim 1 or 2.

Effects of the Invention

According to the present invention, since the own weight of the electric tool is not applied to the guide rails provided on the attachment portion of the electric tool for detachably mounting the battery pack, it is possible to prevent the guide rails from being worn out. Therefore, when the holder or the battery pack is attached to the attachment portion of the electric tool, backlash does not occur. This can maintain a better usability and a better electrical connection. In particular, because of a simple structure including the pair of ribs additionally provided on the attachment portion for connection and the interlocking portion of the connecting member for the engagement with the ribs, a considerable increase in the cost can be avoided.

Further, the interlocked portion and the interlocking portion which maintain a conventional electric connection by means of a slide connecting mechanism can be simply provided, and the strength of the guide rails can be increased in the electric tool.

BEST MODE FOR CARRYING OUT THE INVENTION

An embodiment of the present invention will be described hereinafter with reference to the accompanying drawings.

FIG. 1 are perspective views of a chain saw as an example of a rechargeable electric tool, and a chain saw 1 has a conventional structure which includes a housing 2, a guide bar 3 protruding from a front side of the housing 2, a chain 4 looped around an outer periphery of the guide bar 3 in a tensioned state, and a drive mechanism, such as a motor (not shown), and a sprocket (not shown), which are built in the housing 2 for rotating the chain 4 along the guide bar 3. A handle having a switch lever 6 is provided at an upper side of the housing 2, and extending in a front-and-rear direction, and an attachment portion 7 to which a battery pack 11 as an electric power source is detachably mounted is arranged at a rear end of the handle 5. The reference number 8 indicates a recess formed in a front-side inner surface of the handle 5 in the proximity of the switch lever 6. The recess 8 is used for engagement with a switch rod 17 described later.

A pair of electrode terminal plates 9, 9 extending parallel to each other in an up-and-down direction are provided on the attachment portion 7, and a pair of guide rails 10, 10 each having an L-shaped transverse section are provided outside the electrode terminal plates 9, 9. The guide rails 10 protrude parallel to the electrode terminal plates 9, 9 such that end portions thereof face to each other. Although not shown in the figures, a pair of slide rails provided at an upper surface of the battery pack 11 is where the guide rails are fitted between the pair of guide rails 10, 10, and a pair of electrode terminals which are electrically connected with the electrode terminal plates 9, 9 between the slide rails. To be more specific, when the slide rails of the battery pack 11 are fitted inside and between the pair of guide rails 10, 10 and slid along the guide rails 10, 10, a hook button 12 provided on the battery pack 11 is brought into engagement with a locking hole 13 of the attachment portion 7. Then, as seen in FIG. 1(B), the battery pack 11 is mounted to the attachment portion 7 and an electric connection is made.

A bolt attachment hole 14 used for connection with a holder 30 which will be described later is formed centrally in one end of the attachment portion 7 from which the battery pack 11 is inserted. The attachment hole 14 extends inward into the interior of the handle 5.

Further, a pair of ribs 15, 15 as an interlocked portion used for connection with the holder protrudes from right and left outer surfaces of the attachment portion 7 that are outer sides of the guide rails 10, 10. The ribs 15, 15 are parallel to the guide rails 10, 10 and have substantially the same length as that of the guide rails 10, 10. Bolt attachment holes 16, 16 used for connection with the holder 30 are formed in one ends of the ribs 15, 15 opposite to the other ends from which the battery pack is inserted, in such positions that the attachment holes 16, 16 are coaxial with each other in a right-and-left direction orthogonal to the guide rails 10, 10.

A switch rod 17 as a switch restriction device can be held bridging between the one end of one rib 15 near the attachment hole 16 and the recess 8 formed in the handle 5 of the chain saw 1. As seen in FIGS. 2 and 3, the switch rod 17 has a distal end to be fitted into the recess 8, and includes an extension portion 18 and a hook portion 19. The extension portion 18 is an inverted L-shape and extends within a front-and-rear space surrounded by the handle 5. The hook portion 19 extends from an end of the extension portion 18 while curving along an outer surface of the attachment portion 7 and has a distal end which can be engaged with the end of the rib 15. Namely, in a state where the hook portion 19 is engaged with the end of the rib 15 with the distal end of the extension portion 18 being fitted into the recess 8, the extension portion 18 depresses the switch lever 6 so that a switch (not shown) provided on the handle 5 is turned ON (see FIG. 6). Further, the extension portion 18 has an insertion hole 20 into which one end of an L-shaped hexagonal wrench can be inserted, and an engagement strip 21 by which the other end of the hexagonal wrench can be held, so that the hexagonal wrench can be attached to the switch rod 17 along the extension portion 18.

Next, a description will be given of a holder to which the chain saw 1 is connected.

FIG. 4 is a perspective view illustrating one example of the holder 30. The holder 30 includes an elongated hollow pipe 31, a connecting member 32 provided at one end of the pipe 31 and configured to connect the chain saw 1, and a handle 33 provided at the other end of the pipe 31 and to which the battery pack 11 is mounted.

As seen in FIGS. 5 to 8, the connecting member 32 is a molded article made of synthetic resin and fixed to the distal end of the pipe 31 by screws. A connecting portion 34 for connecting the connecting member 32 to the chain saw 1 is provided at an upper surface of the connecting member 32 that is orthogonal to the pipe 31. The connecting portion 34 includes a U-shaped connecting wall 35 as an interlocking portion protruding along an outer periphery of the connecting portion 34, and a rectangular-shaped terminal connecting portion 36 protrusively provided inside the connecting wall 35. A pair of parallel end portions 37, 37 of the connecting wall 35 are sized to cover the pair of guide rails 10, 10 of the chain saw 1 from outside, and have opposed surfaces in which a pair of recessed grooves 38, 38 are formed for allowing the pair of ribs 15 of the guide rails 10, 10 to be inserted from an open-side of the connecting wall 35.

The reference number 39 indicates a through hole formed in each end portion 37 of the connecting wall 35 such that when the pair of ribs 15, 15 have been inserted into the corresponding recessed grooves 38, 38 into its connecting state, each of the attachment holes 16 of the ribs 15, 15 is aligned with the corresponding through hole 39. A groove 40 is formed in the connecting portion 34 at an inner bottom portion of the end portion 37 corresponding to the rib 15 to which the switch rod 17 is attached. When the hook portion 19 of the switch rod 17 is fitted into the groove 40, the hook portion 19 is allowed to be engaged with the rib 15.

Further, the terminal connecting portion 36 has a pair of slits 41, 41 which extends from an upper surface of the terminal connecting portion 36 to an open-side surface of the connecting wall 35 in a manner parallel to each other and having the same distance as that of the pair of electrode terminal plates 9, 9 of the attachment portion 7. An electrode terminal 42 is provided in each slit 41 so as to hold the inserted electrode terminal plate 9 and make an electric connection between them.

Meanwhile, the handle 33 consists of right and left halves which are made of synthetic resin using a split mold and symmetrical to each other. The handle 33 is formed by sandwiching the rear end of the pipe 31 between the right and left halves and fixing them by screws. As seen in FIG. 9, the handle 33 accommodates therein a switch 44 to which lead wires 43 extending from the electrode terminals 42 of the connecting member 32 and wired through the pipe 31 are connected, a switch lever 45 configured to depress a plunger of the switch 44 to turn ON the switch 44, and a lock-off button 46 which is normally urged by a coil spring to a position where a depression of the switch lever 45 is inhibited but allows the depression of the switch lever 45 when the lock-off button 46 is depressed.

An attachment portion 47 for the battery pack 11 is arranged at a lower end of the handle 33. Similar to the attachment portion 7 of the chain saw 1, the attachment portion 47 includes a pair of guide rails 48, 48 (without ribs at their outer surfaces), a pair of electrode terminal plates 49, 49 positioned inside and between the guide rails 48, 48, and a locking hole 50 with which the hook button 12 of the battery pack 11 is engaged. The electrode terminal plates 49, 49 are connected to the switch 44 through lead wires (not shown).

According to the chain saw 1 and the holder 30 configured as described above, the attachment portion 7 of the chain saw 1 from which the battery pack 11 has been removed and the connecting portion 34 of the connecting member 32 are coupled in such a manner that the pair of ribs 15, 15 of the guide rails 10, 10 are positioned to be fitted into the recessed grooves 38, 38 of the connecting wall 35. Then the guide rails 10, 10 are slid along and between the end portions 37, 37 of the connecting wall 35 and the terminal connecting portion 36. When the ends of the guide rails 10, 10 are brought into contact with inner base portions of the connecting wall 35, the sliding movement of the guide rails 10, 10 is stopped. In this position, the electrode terminal plates 9, 9 of the attachment portion 7 enter the slits 41, 41 of the terminal connecting portion 36 so that an electric connection with respect to the electrode terminals 42, 42 can be made.

Thereafter, the switch rod 17 is attached in such a manner that the hook portion 19 is engaged with the rib 15 between the end portion 37 of the connecting wall 35 and the guide rail 10 while the distal end of the extension portion 18 is engaged with the recess 8 of the handle 5. In this position of the switch rod 17, a hexagon socket head cap bolt 22 is screwed into the attachment hole 14 and the attachment holes 16, 16, respectively, from below and from right and left sides of the connecting member 32 by means of the hexagonal wrench. Accordingly, as seen in FIGS. 6-8 and 10, the chain saw 1 can be connected to the connecting member 32 through the connecting portion 34. Since the weight of the chain saw 1 is applied to the ribs 15, 15 provided on the outer surfaces of the guide rails 10, 10 and the end portions 37, 37 of the connecting wall 35, the guide rails 10, 10 are free from the load.

In this connecting state, the extension portion 18 of the switch rod 17 depresses the switch lever 6 so as to always maintain the ON state of the chain saw-side switch. It should be noted that the handle 5 of the chain saw 1 has a lock-off button 23 identical to that provided on the handle 33, and upon connection, it is necessary to attach the switch rod 17 while the lock-off button 23 is being depressed.

In the case of the handle 33, the slide rails of the battery pack 11 are fitted inside and between the pair of guide rails 48, 48 of the attachment portion 47 and then slid along the guide rails 48, 48 to thereby cause the hook button 12 to be brought into engagement with the locking hole 50. This can cause the electrode terminal plates 49, 49 of the attachment portion 47 to be electrically connected with the electrode terminals on the battery pack 11, and as seen in FIGS. 9 and 10, the battery pack 11 is assembled with the handle 33.

According to the chain saw 1 and the holder 30 in the above embodiment, since the own weight of the chain saw 1 is not applied to the guide rails 10, 10 of the chain saw 1, it is possible to prevent the guide rails 10, 10 from being worn out. Therefore, when the holder 1 or the battery pack 11 is attached, backlash does not occur. This can maintain a better usability and a better electrical connection. In particular, because of a simple structure including a pair of ribs 15, 15 provided on the guide rails 10, 10 and the connecting wall 35 of the connecting member 32 for retaining the ribs 15, 15, a considerable increase in the cost can be avoided.

Further, the interlocked portion is arranged as a pair of ribs 15, 15 each provided on a corresponding outer surface of the pair of guide rails 10, 10 and protruding parallel to the pair of guide rails 10, 10, to be connecting wall 35 positioned outside the pair of guide rails 10, 10 and having opposed surfaces in which a pair of recessed grooves 38, 38 are formed for allowing the pair of ribs 15, 15 to be fitted into the recessed grooves 38, 38. Therefore, the interlocked portion and the interlocking portion which maintain a conventional electric connection by means of a slide connecting mechanism can be simply provided, and the strength of the guiderails 10, 10 can be increased.

In the above embodiment, a connection using the bolts is employed in addition to the engagement between the ribs and the connecting wall. However, the number of bolts and/or the connecting positions may be changed where appropriate. In the case where a locking mechanism such as a hook button is employed, the connection using the bolts may be omitted.

Further, the interlocked portion of the electric tool and the interlocking portion of the holder are not limited to those disclosed in the above embodiment, and various design changes may be made where appropriate. For example, a plurality of ribs and recessed grooves may be formed on each of the right and left sides, a plurality of projections may be arranged in line in place of the rib, and the connecting wall may be divided into a pair of right and left walls in place of a U-shaped wall.

Further, in the above embodiment, the present invention has been applied to a structure in which the electric tool and the battery pack are slidably coupled. However, the present invention may be applicable to a conventional structure as described in the background art, in which a hook button is brought into engagement with the attachment portion by inserting an insertion portion of the battery pack into the attachment portion. To be more specific, while an additional interlocked portion (recess, etc.) is formed in an outer surface of the attachment portion other than the interlocked portion for the hook button, the connecting member has a connecting wall or the like that is positioned outside the attachment portion and provided with an interlocking portion (hook portion, etc.) engageable with the interlocked portion. This can also provide a connection without utilizing the interlocked portion for the battery pack.

On the contrary, the switch restriction device is not limited to the switch rod disclosed in the above embodiment, and in accordance with the position, etc. of the switch lever, the configuration of the switch rod and/or the engagement position, etc. of the switch rod with respect to the electric tool may be modified where appropriate. However, as described in the above embodiment, if the switch rod is configured to be engageable with the end portion of the rib, and in addition to the connection of the connecting member, to be interposed and fixed by sandwiching between the attachment portion and the connecting wall, the attachment of the switch rod can be advantageously performed without any difficulty.

Other than those described above, various design changes may be made on the handle of the holder; for example, the lock-off button may not be provided, an auxiliary handle may be provided in a continuous manner, and the pipe may be a telescopically expandable member. Further, the electric tool connected to the holder is not limited to a chain saw, and other types of tools such as pruning shears, reciprocating saws, hedge trimmers, circular saws (for pruning), and grass shears may be used.

EXPLANATION OF REFERENCE NUMERALS

Figure 1:
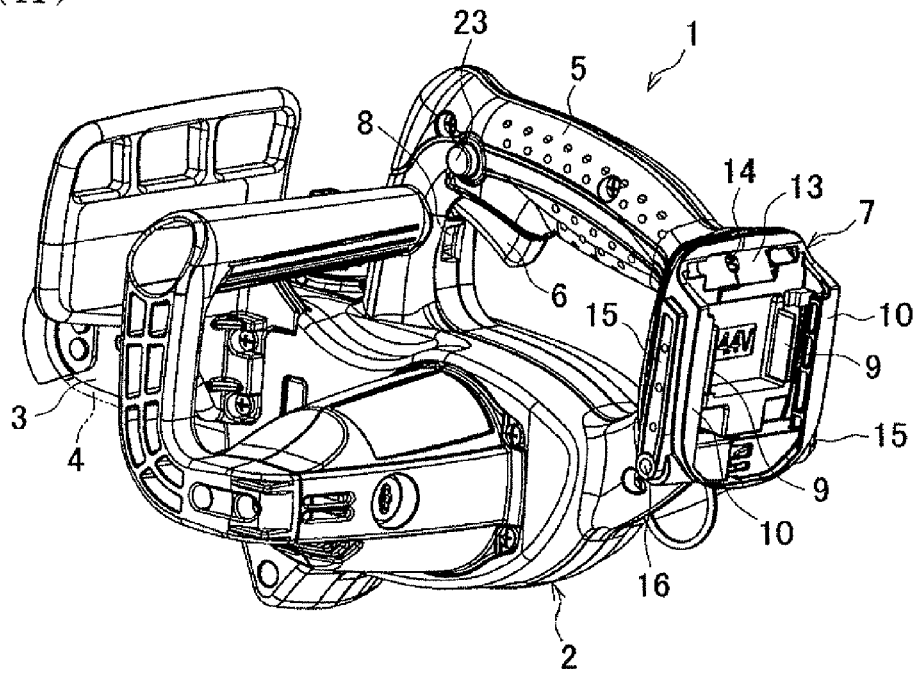
FIG. 1 are perspective views of a chain saw, in which (A) shows a state in which a battery pack is removed, and (B) shows a state in which the battery pack is mounted.
Figure 1:
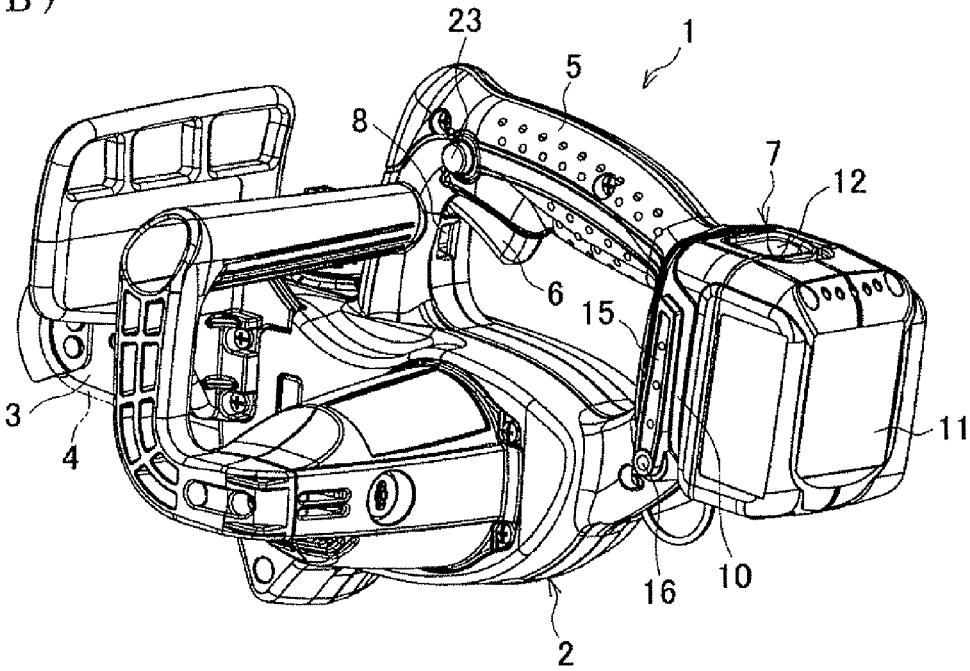
Figure 2:
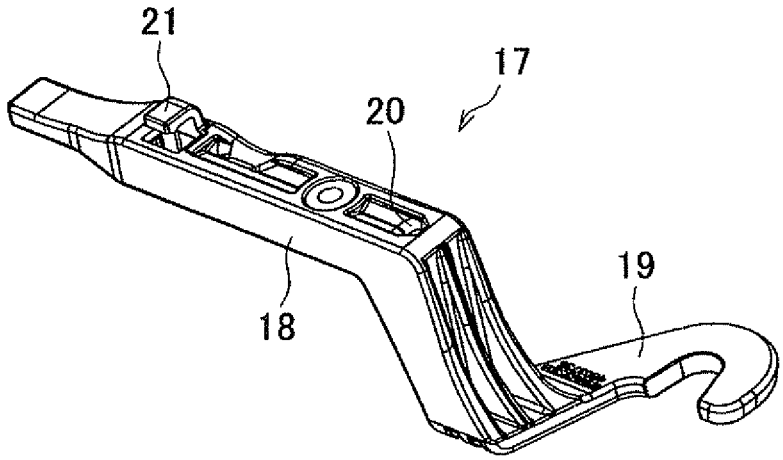
FIG. 2 are explanatory views of a switch rod, in which an upper view is a perspective view as viewed from above, and a lower view is a perspective view as viewed from below.
Figure 2:
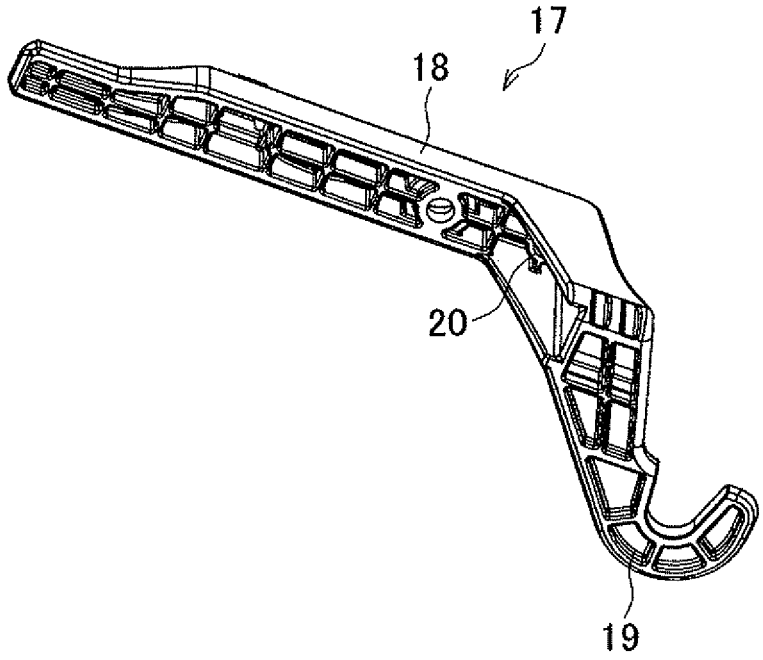
Figure 3:
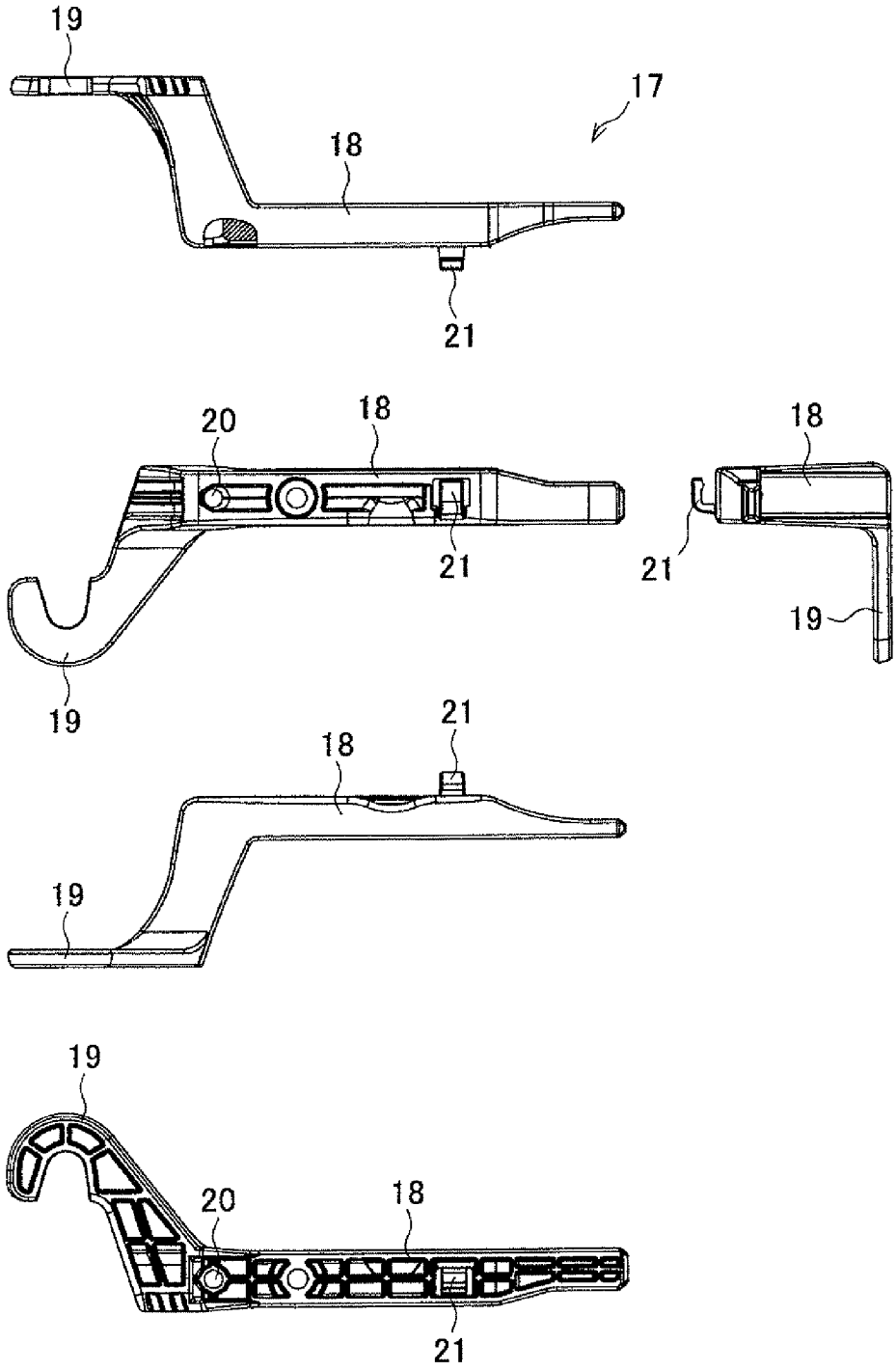
FIG. 3 are explanatory views of the switch rod, respectively showing a back view, a top view, a front view, and a bottom view from the upper-side of the drawing, and a right side view at the right-hand side of the drawing.
Figure 4:
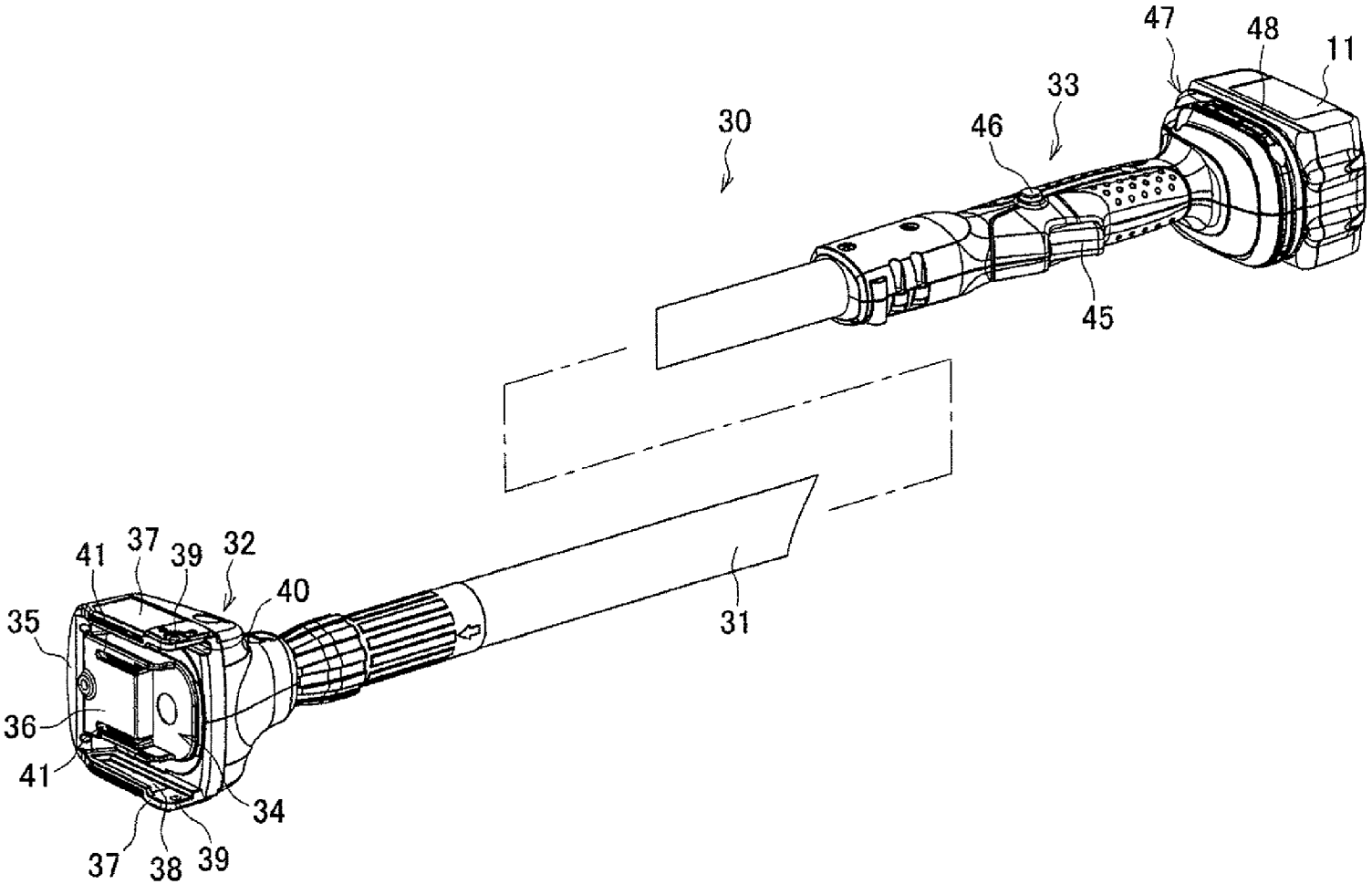
FIG. 4 is a perspective view of a holder, illustrating a state in which the battery pack is mounted.
Figure 5:
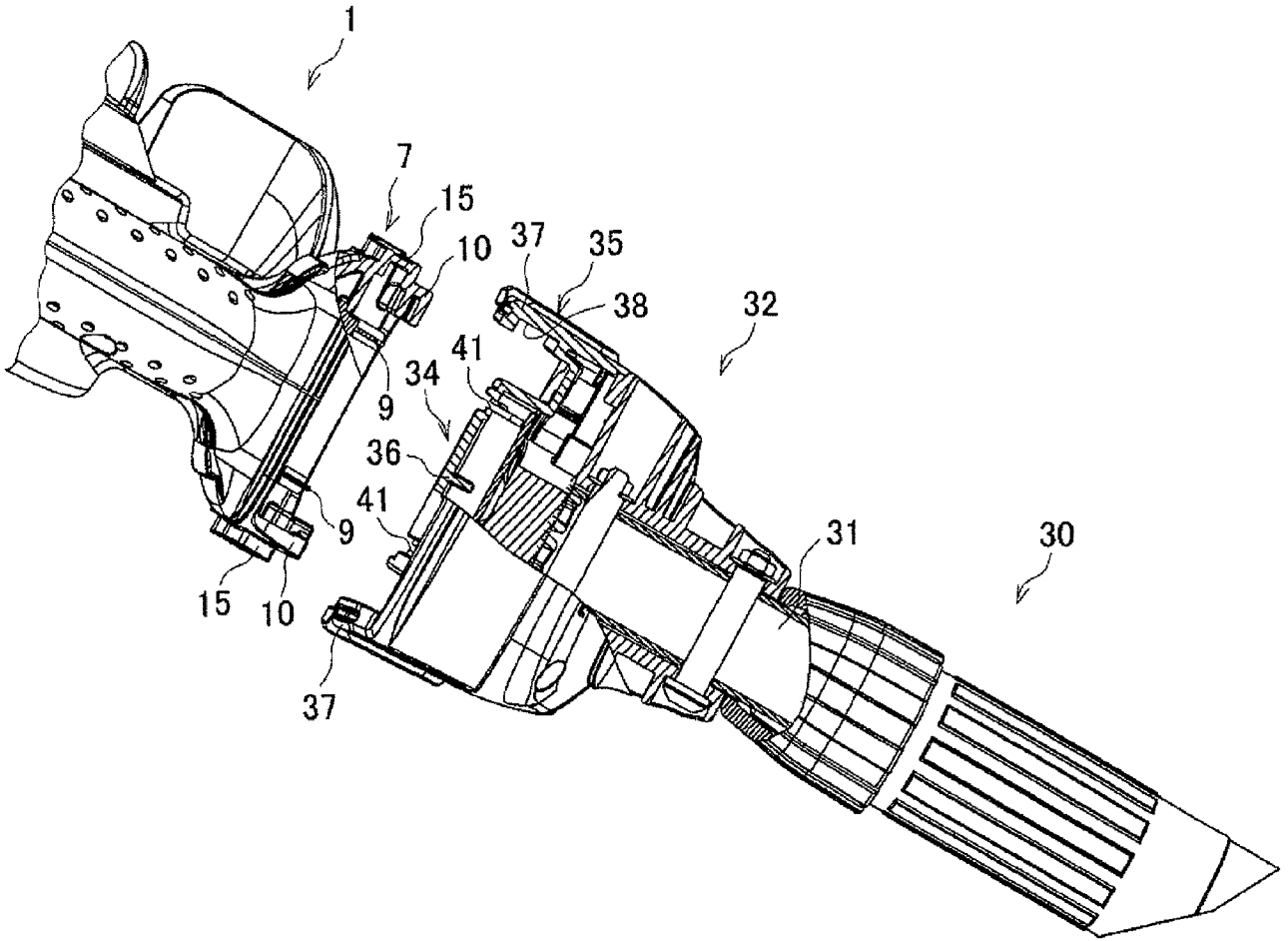
FIG. 5 is an explanatory view illustrating an attachment portion of the chain saw and a connecting member of the holder.
Figure 6:
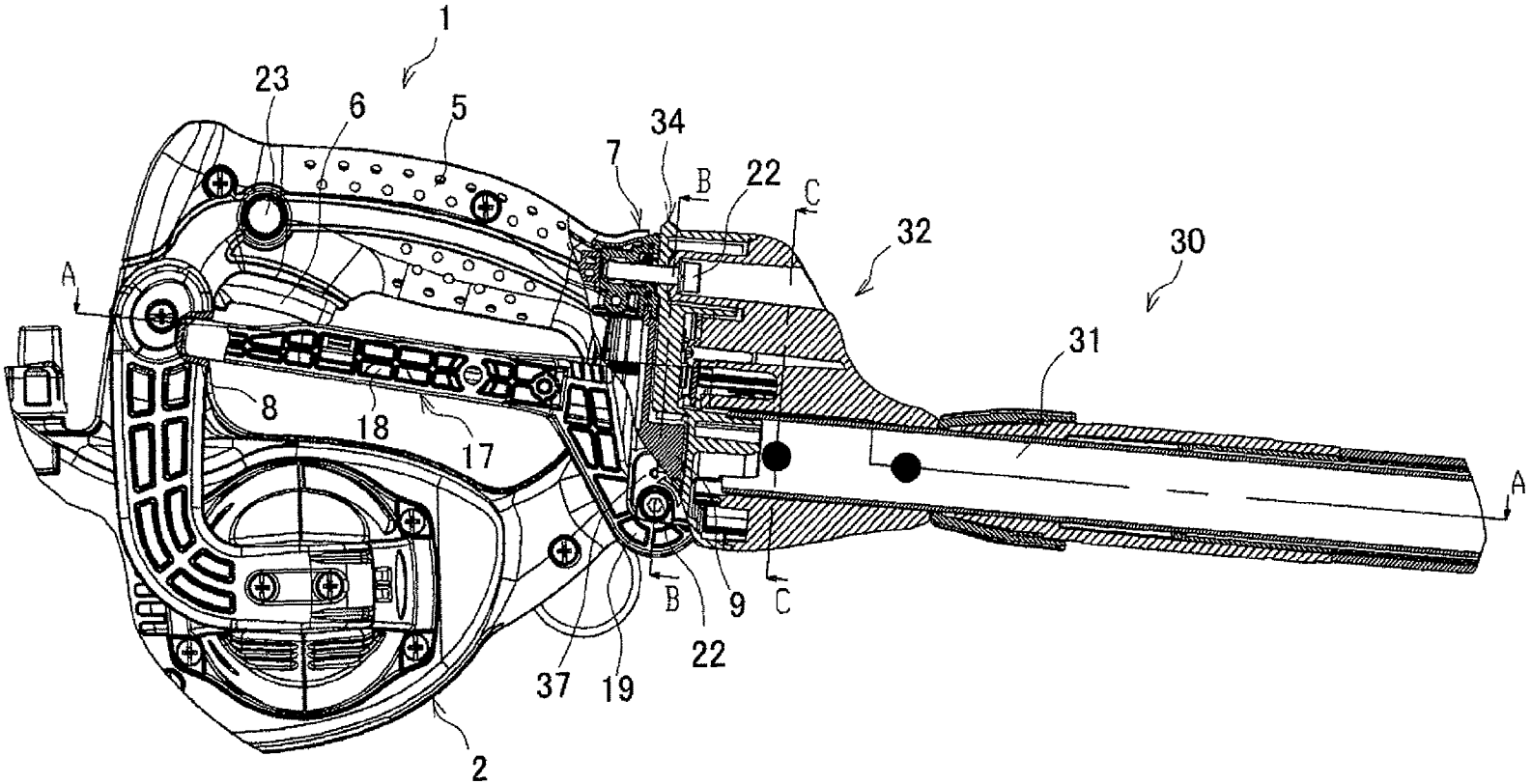
FIG. 6 is a partial cross section illustrating a state in which the chain saw is connected to the connecting member of the holder.
Figure 7:
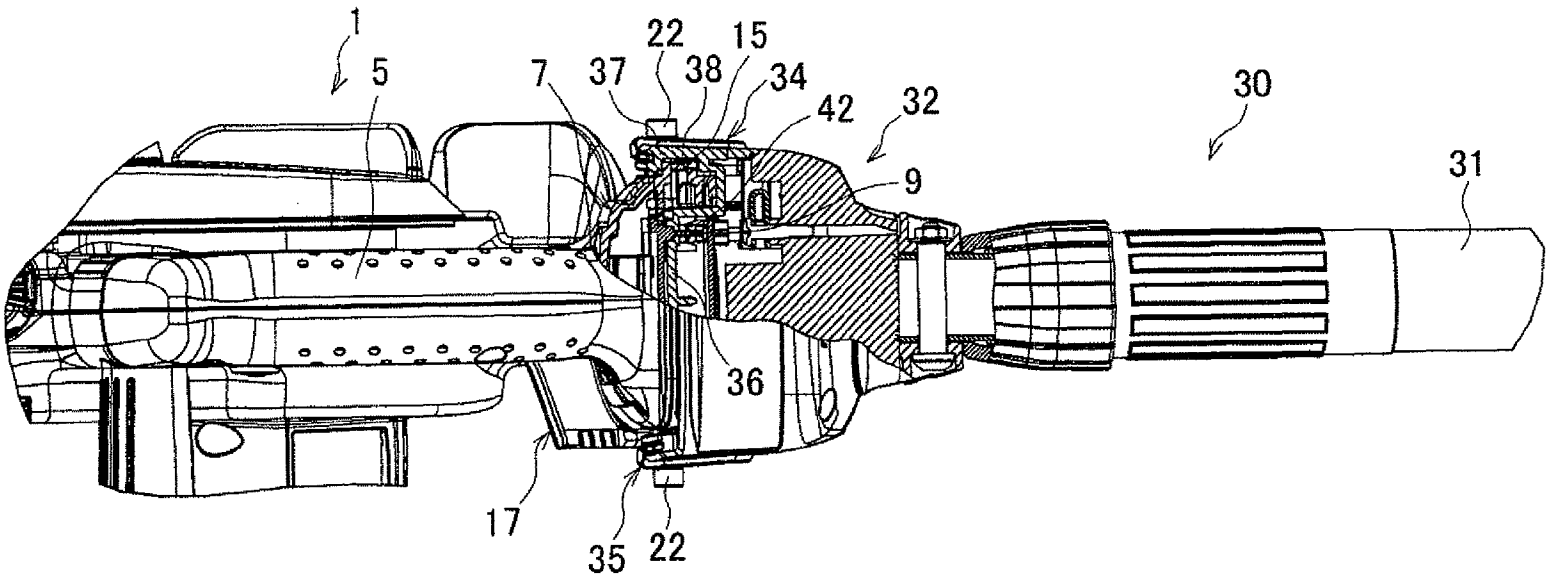
FIG. 7 is a sectional view taken along the line A-A.
Figure 8:
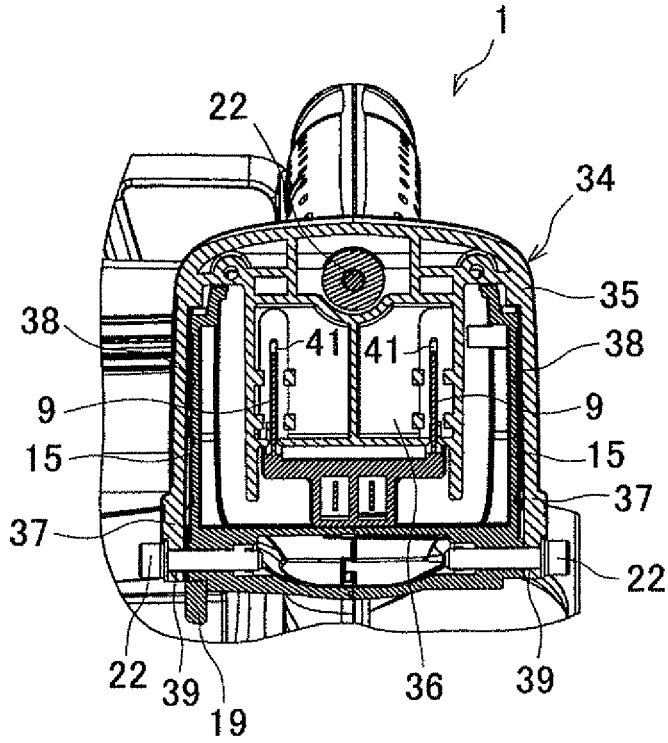
FIG. 8(A) is a sectional view taken along the line B-B.
FIG. 8(B) is a sectional view taken along the line C-C.
Figure 8:
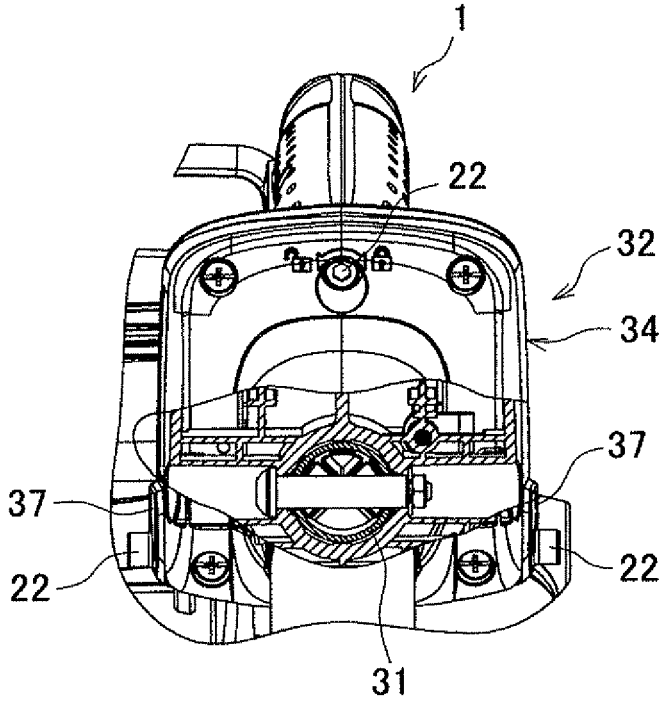
Figure 9:
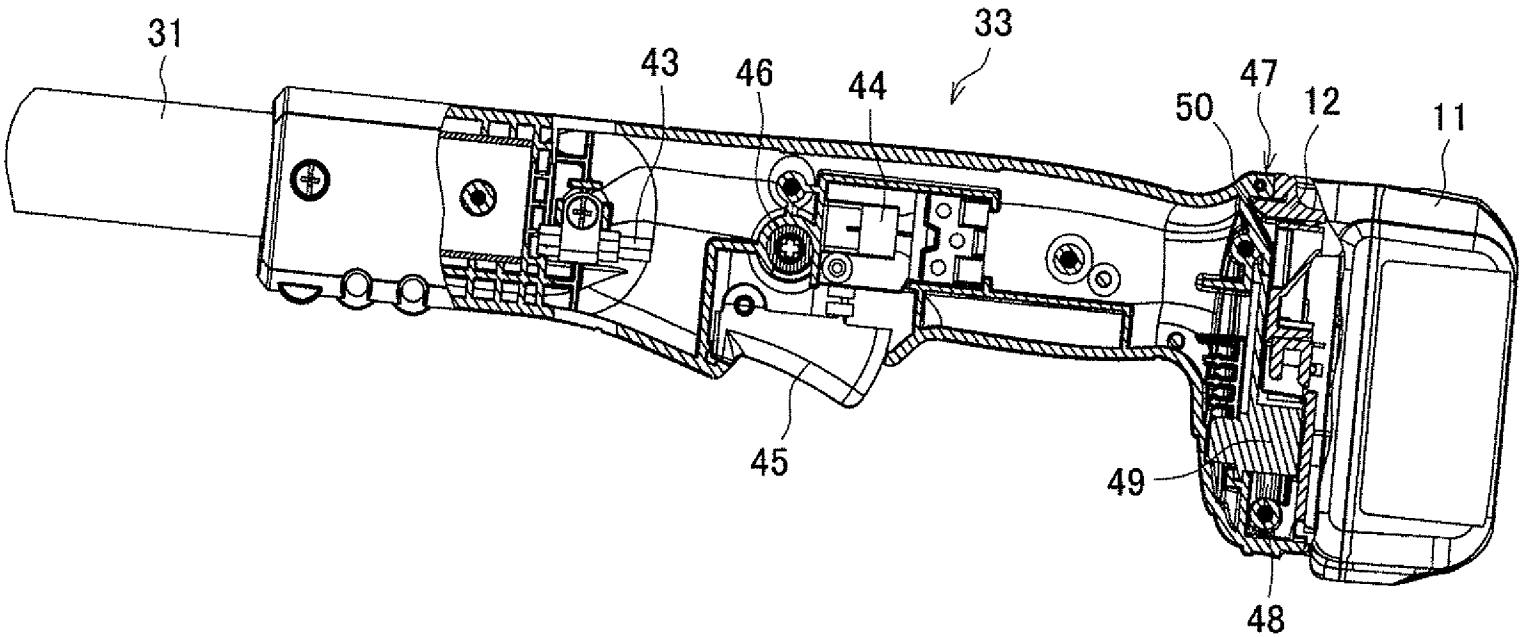
FIG. 9 is a partial cross section illustrating a state in which the battery pack is mounted to a handle of the holder.
Figure 10:
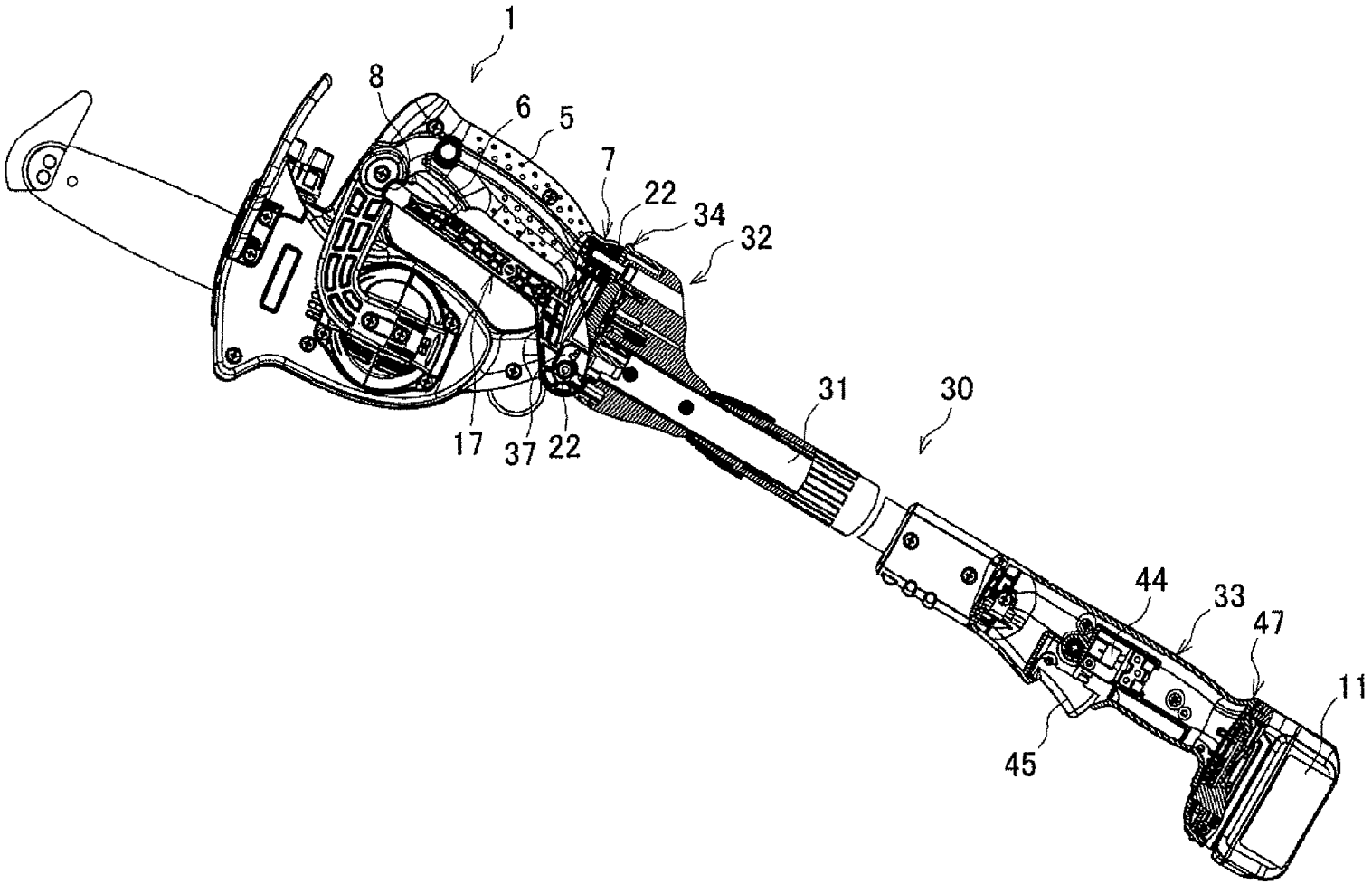
FIG. 10 is an explanatory view of the chain saw to which the holder is connected.

1—CHAIN SAW, 2—HOUSING, 5—HANDLE, 6—SWITCH LEVER, 7—ATTACHMENT PORTION, 8—RECESS, 9—ELECTRODE TERMINAL PLATE, 10—GUIDE RAIL, 11—BATTERY PACK, 15—RIB, 17—SWITCH ROD, 18—EXTENSION PORTION, 19—HOOK PORTION, 30—HOLDER, 31—PIPE, 32—CONNECTING MEMBER, 33—HANDLE, 34—CONNECTING PORTION, 35—CONNECTING WALL, 36—TERMINAL CONNECTING PORTION, 37—END PORTION, 38—RECESSED GROOVE, 42—ELECTRODE TERMINAL, 44—SWITCH, 45—SWITCH LEVER, 47—ATTACHMENT PORTION, 48—GUIDE RAIL, 49—ELECTRODE TERMINAL PLATE

The invention claimed is:

1. An electric tool having an attachment portion, the attachment portion comprising, in a detached mode:

an exterior wall having an inner surface facing a center of the attachment portion and having an outer surface facing away from the center of the attachment portion;

an interlocked portion configured to be used for connection with a remote control holder; and guide rails extending from the exterior wall of the attachment portion toward the center of the attachment portion, wherein attachment of a battery pack to the attachment portion is made through sliding engagement such that slide rails provided on the battery pack are fitted inside and between the guide rails of the attachment portion, and wherein the interlocked portion is arranged as ribs on the outer surface of the exterior wall of the attachment portion and protruding therefrom away from the center of the attachment portion so as to be parallel to the guide rails such that the interlocked portion connects to the remote control holder outside the exterior wall of the attachment portion.

2. The electric tool according to claim 1, wherein attachment holes configured to be used for connection with the remote control holder are formed in ends of the ribs opposite ends from which the battery pack is inserted, in such positions that the attachment holes are coaxial with each other in a direction orthogonal to the guide rails.

3. A remote control holder for the electric tool of claim 1, the remote control holder comprising:

a connecting member connectable to the attachment portion of the electric tool;

a switch restriction device connected to the connecting member and configured to retain a switch of the electric tool in an ON state;

a handle connected to the connecting member through a pipe and configured such that the battery pack is detachably mounted thereto;

a connecting apparatus configured to electrically connect the electric tool attached to the connecting member and the battery pack mounted to the handle; and a switching member provided on the handle and configured to control the electric connection between the electric tool and the battery pack via the connecting member, wherein the connecting member comprises an interlocking portion configured to engage with the ribs so as to support the attachment portion, so that the connecting member is connectable to the attachment portion by the engagement between the ribs and the interlocking portion.

4. The remote control holder according to claim 3, wherein the interlocking portion is formed as wall members positioned outside the guide rails and having opposed surfaces in which recessed grooves are formed so as to allow the ribs to be fitted into the recessed grooves.

5. The remote control holder according to claim 4, wherein through holes are formed in ends of the wall members such that when the ribs have been inserted into the recessed grooves, attachment holes of the ribs are aligned with the through holes.

6. The remote control holder according to claim 3, wherein the switch restriction device is a switch rod comprising:

an extension portion configured to be fitted onto the electric tool, and a hook portion engageable with an end portion of one of the ribs, and when the extension portion is fitted onto the electric tool and the hook portion is engaged with the one of the ribs, a switch lever provided on the electric tool is depressed by the extension portion.

7. The remote control holder according to claim 6, wherein a groove is formed at an inner bottom portion of a wall member of the interlocking portion, corresponding to the one of the ribs to which the switch rod is attached, such that when the hook portion is fitted into the groove, the hook portion is allowed to be engaged with the one of the ribs.

8. An electric tool, wherein the remote control holder according to claim 3 is connected to the electric tool.

9. The electric tool according to claim 1, wherein the interlocked portion is configured to not contact the battery pack when the battery pack is attached to the attachment portion.

10. The electric tool according to claim 1, wherein the remote control holder covers at least a portion of a surface of the ribs facing away from the center of the attachment portion.

* * * * *